United States Patent [19]

Suzuki

[11] Patent Number: 4,939,973

[45] Date of Patent: Jul. 10, 1990

[54] TONE SIGNAL GENERATION DEVICE HAVING WAVESHAPE CHANGING MEANS

[75] Inventor: Hideo Suzuki, Hamamatsu, Japan

[73] Assignee: Nippon Gakki Seizo Kabushiki Kaisha, Hamamatsu, Japan

[21] Appl. No.: 245,991

[22] Filed: Sep. 14, 1988

Related U.S. Application Data

[63] Continuation of Ser. No. 6,321, Jan. 14, 1987, abandoned, which is a continuation of Ser. No. 743,476, Jun. 10, 1985, abandoned.

[30] Foreign Application Priority Data

Jun. 12, 1984 [JP] Japan ..... 59-119084
Nov. 4, 1984 [JP] Japan ..... 59-231294

[51] Int. Cl.[5] ..... G10H 1/14; G10H 1/16; G10H 7/04

[52] U.S. Cl. ..... 84/605; 84/625; 84/626

[58] Field of Search ..... 84/1.01, 1.11–1.13, 84/1.19–1.27, 604–607, 622–633, DIG. 7

[56] References Cited

U.S. PATENT DOCUMENTS 4,130,043 12/1978 Niimi ..... 84/1.19 X
4,223,583 9/1980 Deutsch ..... 84/1.01
4,257,303 3/1981 Nagai et al. ..... 84/1.22
4,297,933 11/1981 Nishimoto ..... 84/1.01
4,383,462 5/1983 Nagai et al. ..... 84/1.26
4,466,326 8/1984 Ogura et al. ..... 84/1.22
4,502,361 3/1985 Viitanen et al. ..... 84/1.26
4,520,708 6/1985 Wachi ..... 84/1.26
4,536,853 8/1985 Kawamoto et al. ..... 84/1.01 X
4,554,858 11/1985 Wachi et al. ..... 84/1.19

*Primary Examiner*—Stanley J. Witkowski
*Attorney, Agent, or Firm*—Spensley, Horn Jubas & Lubitz

[57] ABSTRACT

A waveshape memory stores a full waveshape of a tone from the start to the end of sounding of the tone or a portion thereof in plural periods. A tone wave signal produced by reading this waveshape memory is applied to a tone color circuit where its tone color is changed. The tone wave signal whose tone color has been changed and the tone wave signal whose tone color has not been changed are both multiplied with respective coefficients whereby these tone wave signals are weighted. The weighted tone wave signals are added together to provide a mixed tone signal. By controlling the coefficients, the tone color imparted on the mixed signal is variously determined. The coefficients for the tone color control are provided in accordance with key scaling, key touch or operation states of control knobs. Thus tone signals exhibiting a variety of tone color changes are obtained using not so many wave memories.

26 Claims, 7 Drawing Sheets

TONE SIGNAL GENERATION DEVICE HAVING WAVESHAPE CHANGING MEANS

This is a continuation of application Ser. No. 006,321, filed Jan. 14, 1987 and now abandoned, which is a continuation of application Ser. No. 743,476 filed June 10, 1985 and now abandoned.

BACKGROUND OF THE INVENTION

This invention relates to a tone signal generation device of a waveshape memory reading type and, more particularly, to a tone signal generation device capable of generating a high-quality tone signal by accessing a waveshape memory storing a full or partial waveshape in plural periods from the start of sounding of a tone to the end thereof.

Known in the art is a tone signal generation device capable of generating a high-quality tone simulating closely a tone of a natural musical instrument by storing a full or partial waveshape in plural periods from the start of sounding of a tone to the end thereof in a waveshape memory and accessing this waveshape memory (e.g., U.S. Pat. No. 4,383,462).

Since this prior art tone generation device reads out a full waveshape or a partial waveshape stored in the waveshape memory and provides the read out waveshape directly as a tone signal, a tone color change of a generated tone tends to lack in variation and therefore leaves something to be improved musically. If, in order to improve this defect, the tone generation device is provided with a key scaling control in which a tone color is changed in accordance with a tone pitch or a tone range of a tone to be generated, a touch response control in which the tone color is changed in accordance with an operating manner of a playing key such as a depression speed and a depression strength, and an operator control in which the tone colors are changed in accordance with an operation manner of various control knobs, a plurality of waveshape memories must be provided and one of them must be selected for reading for effecting these controls with a resulting complicated construction of the device and requirement for a tremendous memory capacity of the waveshape memories.

Besides, since a waveshape memory stores a waveshape of plural periods even in a case where the tone color change is not imparted to a tone, the memory capacity of the waveshape memory tends to become large for this reason only. If a low sampling frequency is used with a resulting reduction in the sampling number, the memory capacity accordingly is reduced. This, however, eliminates harmonic components in a high frequency range so that the quality of a tone obtained will be deteriorated.

The present invention, therefore, aims to solve the problem in the tone signal generation device generating a high-quality tone signal that the attempt for introducing a tone color change control such as the key scaling control is inevitably accompanied by a complicated construction of the device and the problem that the waveshape memory requires a tremendous amount of memory capacity.

It is an object of the invention to provide a tone signal generation device capable of imparting the tone color change such as the key scaling with a simple construction using a waveshape memory of a relatively small capacity.

It is another object of the invention to provide a tone generation device capable of generating a tone signal using a waveshape memory of a relatively small capacity without substantially lowering the quality of the generated tone.

SUMMARY OF THE INVENTION

It is a first feature of the tone signal generation device according to the invention that it comprises a waveshape memory storing the above described waveshape data of plural periods (vibratory cycles), waveshape changing means for changing waveshape data read out from said waveshape memory to form waveshape data of a different tone color, combining means for combining the waveshape data read out from this waveshape changing means and the waveshape data read out from the waveshape memory and combining ratio control means for controlling a ratio of combining the two waveshape data in the combining means in response to tone color adjusting signal produced by tone color adjusting means such as a key scaling circuit and a touch responsive control circuit and provides an output of the combining means as a tone signal imparted with a tone color change.

It is a second feature of the tone signal generation device according to the invention that it comprises a waveshape memory storing the above described waveshape data of plural periods and non-linear conversion means for converting a waveshape signal derived from a read out output of this waveshape memory in accordance with a nonlinear function and produces a tone signal from an output of this non-linear conversion means.

It is a third feature of the tone signal generation device that it comprises, in addition to the above described waveshape memory and non-linear conversion means, weighting means for weighting a waveshape signal derived from the read out output of the waveshape memory and a waveshape signal derived from the output of the non-linear conversion means respectively with different weighting coefficients and weighting coefficient generation means for generating the weighting coefficients and produces a tone signal from an output of the weighting means.

According to the first feature, the waveshape signal derived from the read out output of the waveshape memory is changed to a waveshape signal of a different tone color and this changed waveshape signal and the unchanged waveshape signal derived from the read out output of the waveshape memory are mixed with a mixing ratio corresponding to the tone color adjusting information. Accordingly, a tone signal exhibiting various tone color change characteristics depending upon the key scaling or key touch or operation states of control knobs can be provided.

According to the second feature of the invention, a waveshape signal derived from a read out output of the waveshape memory is converted in accordance with a predetermined non-linear function, the waveshape of a signal provided on the output side of the non-linear conversion means is of a different waveshape from that stored in the waveshape memory. Controls such as a tone color change can thereby be performed without increasing the number of memories (or the number of waveshapes stored in a memory) so that the memory capacity can be saved. Furthermore, harmonic components can be enhanced by the non-linear conversion and, accordingly, even if components in a high frequency range are eliminated by lowering of the sampling frequency of a waveshape stored in the memory, a waveshape containing more abundant harmonic components than the waveshape stored in the waveshape memory can be obtained as the output of the non-linear conversion means. Consequently, the capacity of the waveshape memory can be saved without deteriorating the quality of a finally produced tone signal.

According to the third feature of the invention, a waveshape which is different from that stored in the waveshape memory can be obtained by the non-linear conversion as in the second feature, and, in addition, by weighting a waveshape signal derived from an output of the waveshape memory and a waveshape signal of this non-linear conversion means by respectively corresponding weighting coefficients, a tone signal which is a result of combining the two waveshapes with a suitable ratio determined by the weighting coefficients is obtained. Accordingly, by controlling weighting coefficients in response to tone color change parameters such as key scaling, key touch or operation states of control knobs, a tone signal exhibiting various tone color change characteristics can be obtained. Consequently, in the case where waveshape data of plural periods is stored in a waveshape memory and a tone signal of high quality is to be generated on the basis of the waveshape data read out from the waveshape memory, necessity for storing waveshape data individually for the respective tone color change parameters is obviated and, therefore, the problem of increased capacity of the waveshape memory is overcome and the construction of the device can thereby be simplified.

BRIEF DESCRIPTION OF THE DRAWINGS

In the accompanying drawings.

Figure 1:
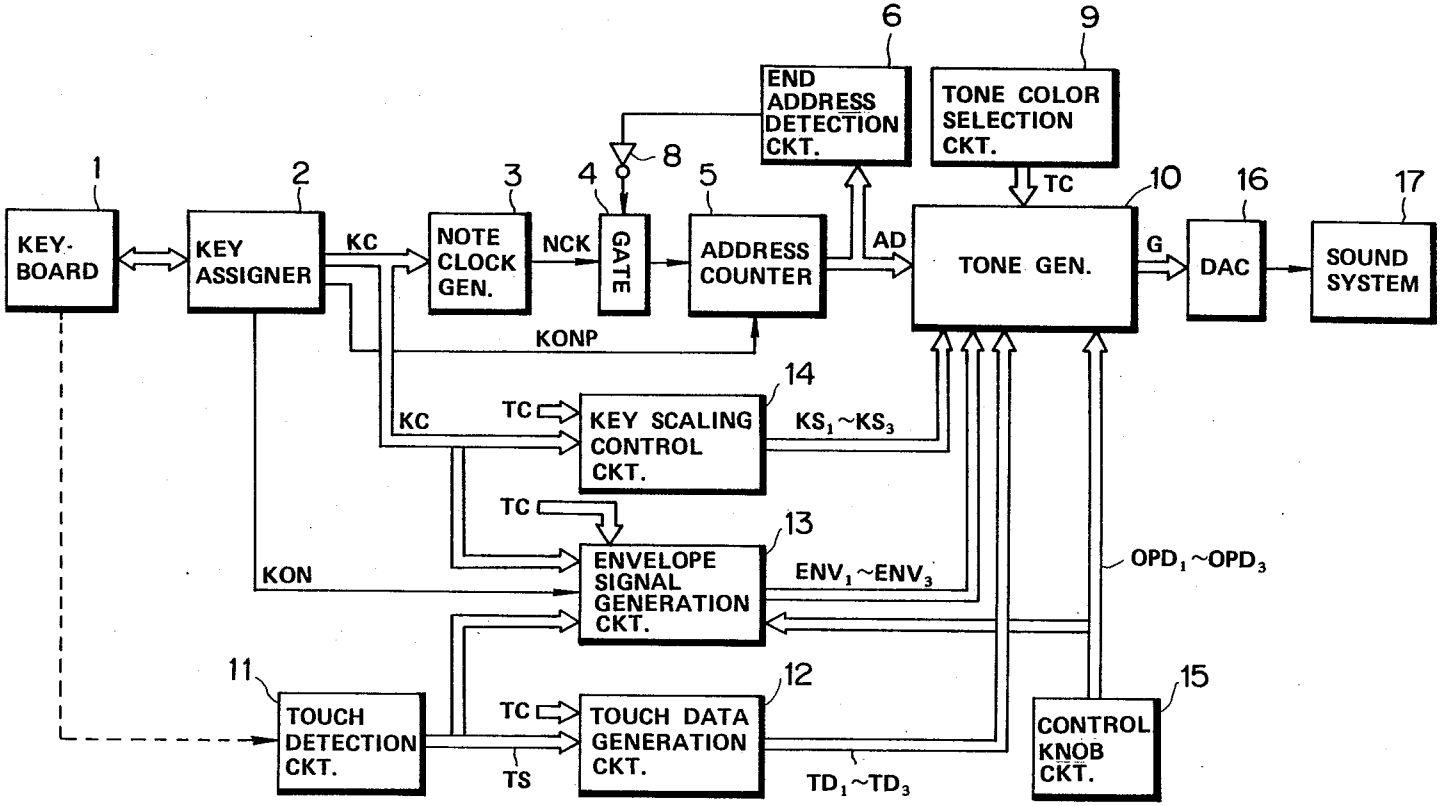
FIG. 1 is a block diagram showing the entire construction of an embodiment of an electronic musical instrument incorporating the tone signal generation device according to the invention.
Figure 4:
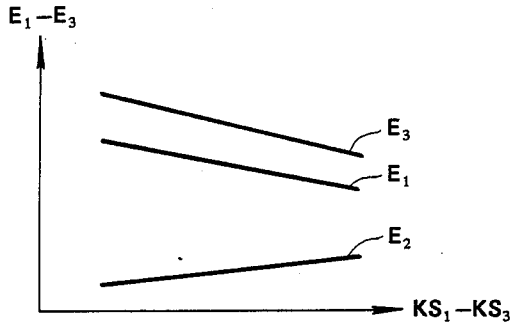
Figure 5:
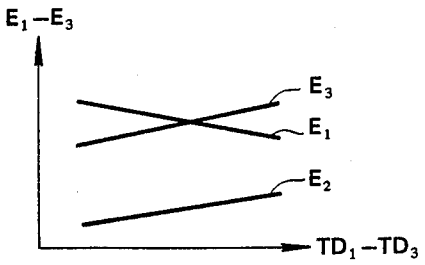
Figure 6:
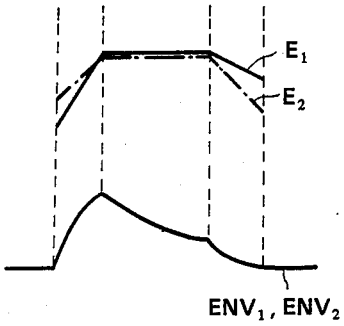
Figure 7A:
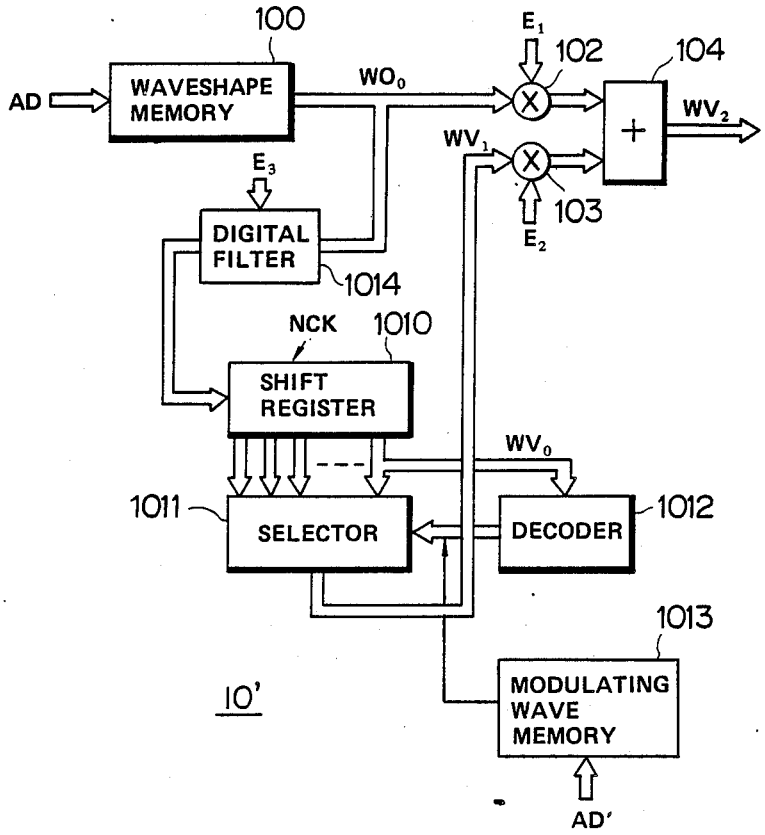

FIGS. *3a–3c* are graphs respectively showing examples of touch data, envelope signals and key scaling information in the embodiment of FIG. 1;

FIGS. 4, 5 and 6 are graphs respectively showing examples of coefficients provided in the embodiment of FIG. 1;

FIG. 7 is a block diagram showing another example of the tone generator;

FIG. 7A is a block diagram showing another example of the tone generator.

Figure 8:
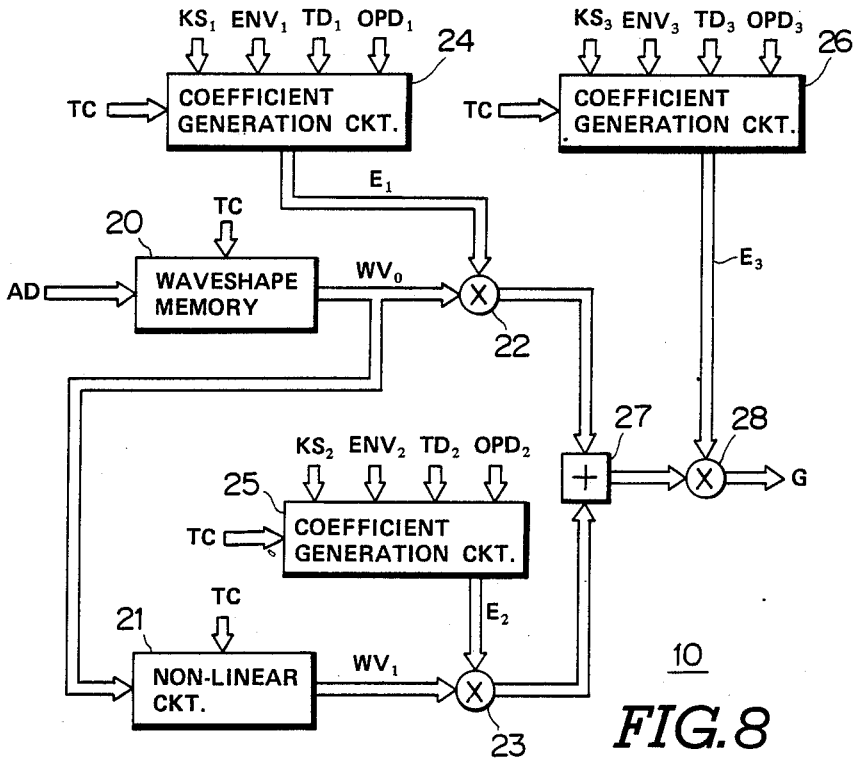
Figure 10:
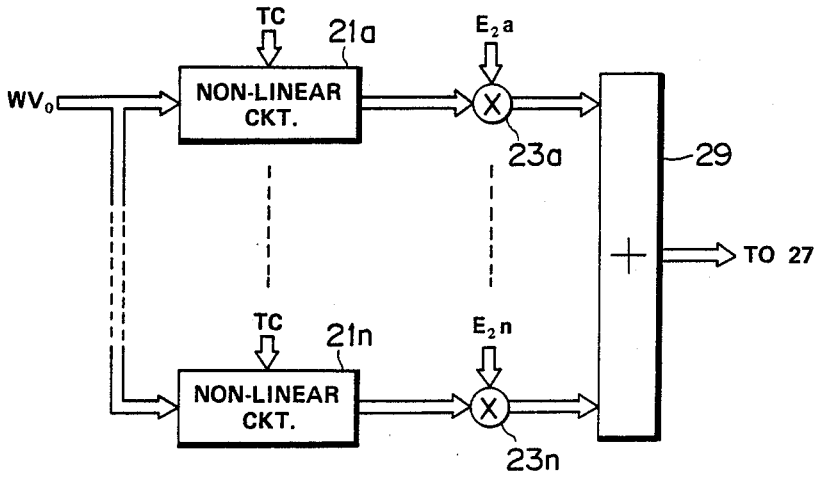
Figure 11:
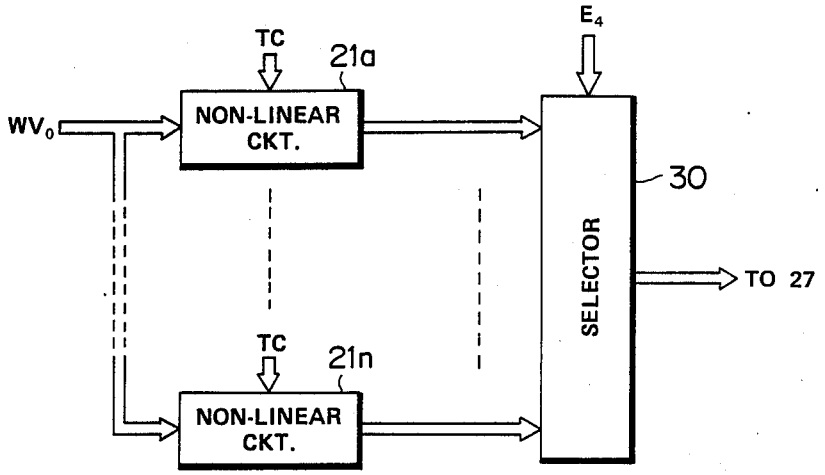

FIG. 8 is a block diagram showing the internal construction of another example of the tone generator of FIG. 1;

FIGS. *9a–9c* are graphs respectively showing examples of input and output waveshapes of the non-linear function and the non-linear circuit; and FIGS. 10 and 11 are block diagrams respectively showing modified examples of the portion including the non-linear circuit in FIG. 8.

DESCRIPTION OF PREFERRED EMBODIMENT

FIG. 1 is a block diagram showing the entire construction of an embodiment of an electronic musical instrument to which the present invention has been applied. The electronic musical instrument of this embodiment has a plurality of time division tone generation channels and is capable of generating simultaneously tones corresponding to plural depressed keys by assigning one or more depressed keys in a keyboard to these time division tone generation channels. In FIG. 1, a keyboard 1 has playing keys for designating tone pitches of tones to be generated. A key assigner 2 detects depressed key or keys in the keyboard 1, assigns key codes KC corresponding to the depressed keys to any of the time division tone generation channels (hereinafter referred simply to as "tone generation channels") and outputs these key codes KC at timings synchronized with the assigned channels on a time shared basis. Simultaneously with the assignment of the key codes KC corresponding to the depressed keys, the key assigner 2 produces a key-on signal KON which keeps logic "1" during a period until the depressed keys are released in synchronism with the assigned channels and, when key code KC for a newly depressed key has been assigned to any of the tone generation channels, produces a key-on pulse KONP (a "1" signal) with a short pulse width at a timing synchronized with the channel to which the newly depressed key has been assigned.

A note clock generator 3 produces, responsive to the key code KC produced by the key assigner 2, a note clock signal NCK of a frequency corresponding to the tone pitch of the depressed key with respect to each of the tone generation channels on a time shared basis. A gate 4 selectively gates out the note clock signal NCK. An address counter 5 counts the note clock signals NCK applied through the gate 4 with respect to each of the tone generation channels to form address signals AD of a waveshape memory in a tone generator 10 to be described later. This address counter 5 has count channels corresponding to the tone generation channels and counts, in corresponding count channels, the note clock signals NCK applied from the note clock generator 3 at timings corresponding to the respective tone generation channels, delivering out counts in the respective count channels as the address signals AD of the waveshape memory on a time shared basis.

In the respective count channels, preceding counts are reset by the key-on pulse KONP produced by the key assigner 2 when a newly depressed key has been assigned to the corresponding tone generation channels and a new counting operation is started from this reset value.

An end address detection circuit 6 detects whether or not the address signal AD for each tone generation channel produced by the address counter 5 has reached a last address value in the waveshape memory. When the address signal AD has reached the last address in the waveshape memory, the circuit 6 supplies an inhibit signal to the gate 4 at a time division timing of this address signal AD to cease the counting operation in the count channel in the address counter 5 in which the count has reached the last address value.

A tone color selection circuit 9 selects a desired tone color such as piano and violin and produces, upon selection, tone color selection information TC representing the selected tone color.

The tone generator 10 comprises a waveshape memory storing waveshape information about the entire waveshape from the start of generation of a tone to the end thereof with respect to each tone color which can be selected by the tone color selection circuit 9 and generates tone signals G corresponding to the tone pitches of the depressed keys by reading out waveshape information in this waveshape memory by the address signals AD provided by the address counter 5. As described above, the tone generator 10 has tone generation channels corresponding to the number of tones which can be simultaneously produced. These tone generation channels are constructed by using the circuit including the waveshape memory on a time shared basis.

A touch detection circuit detects the depression speed (touch speed) or depression strength (touch strength) with respect to a key depressed in the keyboard 1 and produces touch information TS representing such depression speed or strength. A touch data generation circuit 12 generates, responsive to the touch information TS provided by the touch detection circuit 11 and the tone color selection information TC provided by the tone color selection circuit 9, touch data TD of characteristics suited to the selected tone color in accordance with the touch information TS.

In the present embodiment, touch data $TD_1$–$TD_3$ of three channels are produced.

An envelope signal generation circuit 13 generates an envelope signal ENV for changing timewisely the tone color and amplitude of the tone signal G formed in each tone generation channel from the rise to the fall thereof, starting its operation in response to the key-on signal KON produced by the key assigner 2. The envelope signal ENV produced in this circuit has a different waveshape depending upon the selected tone color represented by the tone color selection information TC and is delivered out as envelope signals $ENV_1$–$ENV_3$ of three channels for each selected tone color.

A key scaling control circuit 14 generates, responsive to the key code KC produced by the key assigner 2 and the tone color selection information TC produced by the tone color selection circuit 9, key scaling information KS for controlling the tone color and amplitude of the tone signal G generated in each tone generation channel in accordance with the tone range and the selected tone color of the depressed key. In the same manner as in the above described circuits 12 and 13, the key scaling control circuit 14 produces key scaling information $KS_1$–$KS_3$ of three channels.

A control knob circuit 15 has control knobs for controlling tone colors such as brightness of the tone and tone volume and produces control knob information OPD corresponding to operated states of these control knobs. This circuit likewise produces control knob information $OPD_1$–$OPD_3$ of three channels.

A digital-to-analog converter 16 converts the digital tone signals G for the respective tone generation channels formed in the tone generator 10 to analog tone signals to sound them as musical tones from a sound system 17.

The touch data generation circuit 12, the envelope signal generation circuit 13 and the key scaling control circuit 14 respectively produce, at time division timings corresponding to the respective tone generation channels, touch data $TD_1$–$TD_3$, key scaling information $KS_1$–$KS_3$ and envelope signals $ENV_1$–$ENV_3$ respectively of three channels for controlling the tone color and amplitude of the tone signal G with respect to each of the tone generation channels. Examples of the touch data $TD_1$–$TD_3$ generated by the touch data generation circuit 12, the envelope signal $ENV_1$–$ENV_3$ produced by the envelope signal generation circuit 13 and the key scaling information $KS_1$–$KS_3$ produced by the key scaling control circuit 14 are shown respectively in FIGS. *3a*, *3b* and *3c*. In these examples, data output characteristics of the circuits 12 to 14 differ depending upon the tone color represented by the tone color selection information TC.

Figure 2:
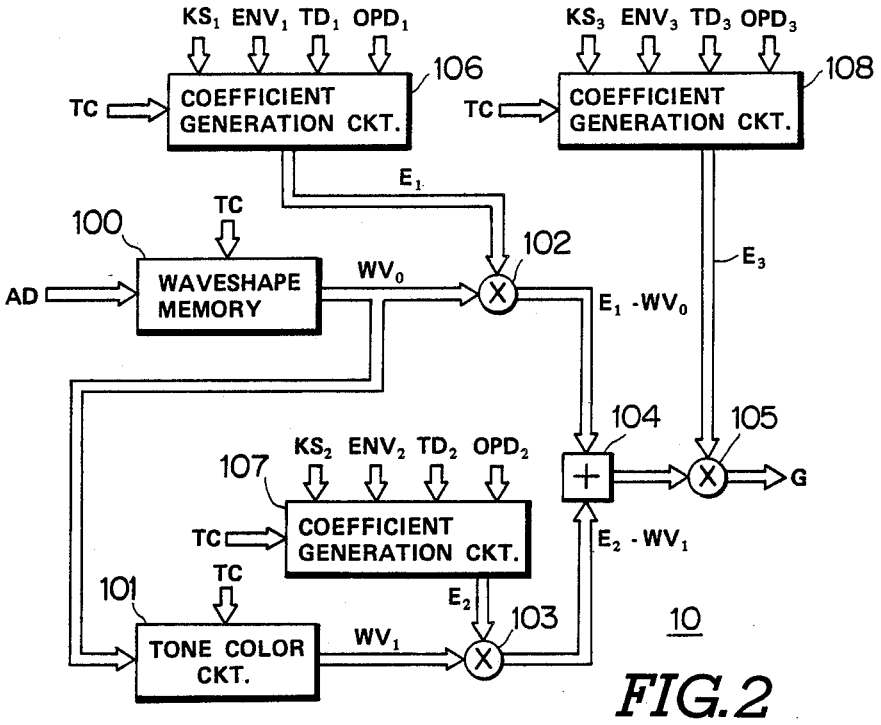
FIG. 2 is a block diagram showing an example of a specific construction of a tone generator shown in FIG. 1.

FIG. 2 is a block diagram showing a specific example of the tone generator 10. The tone generator 10 comprises a waveshape memory 100 which stores waveshape data about a full waveshape from the start of generation of the tone to the end thereof with respect to each tone color which can be selected by the tone color selection circuit 9 and a tone color circuit 101 which changes waveshape data $WV_0$ read out from this waveshape memory 100 in response to the tone color selection information TC and the address signal AD to waveshape data $WV_1$ of other tone color. The tone generator 10 comprises also multipliers 102 and 103 and an adder 104 for combining the waveshape data $WV_0$ read out from the waveshape memory 100 and the waveshape data $WV_1$ read out from the tone color circuit 101 together after weighting them, and further comprises a multiplier 105 for weighting the combined waveshape data $WV_2$ produced by the adder 104 and providing it as a tone signal. The tone generator 10 further comprises three coefficient generation circuits 106–108 which generate, responsive to combined signals of the same channel [$TD_1$, $ENV_1$, $KS_1$ and $OPD_1$]–[$TD_3$, $ENV_3$, $KS_3$ and $OPD_3$] among the three channels of touch data $TD_1$–$TD_3$, envelope signals $ENV_1$–$ENV_3$, key scaling information $KS_1$–$KS_3$ and operator information $OPD_1$–$OPD_3$, a coefficient $E_1$ used for weighting the waveshape data signal $WV_0$ in the multiplier 102, a coefficient $E_2$ used for weighting the waveshape data $WV_1$ in the multiplier 103 and a coefficient $E_3$ used for weighting the combined waveshape data $WV_2$ in the multiplier 105.

The coefficient generation circuits 106–108 are composed of operation circuits or memories or combinations thereof whereas the tone color circuit 101 is composed of a digital filter of desired filter characteristics or the like device. All component parts of the tone generator 10 are operated on a time shared basis to form tone signals assigned to the respective tone generation channels in time division.

The operation of the tone generator 10 of the above construction will now be described. For brevity of explanation, description will be made with respect to one tone generation channel only.

From the waveshape memory 100 is read out successively and sequentially waveshape sample data corresponding to the tone color represented by the tone color selection information TC in accordance with the address signal AD and at a speed corresponding to the tone pitch of the depressed key. The read out waveshape data signal $WV_0$ is supplied to the multiplier 102 in which it is weighted by being multiplied with the coefficient $E_1$. The waveshape data $WV_0$ is also applied to the tone color circuit 101. The tone color circuit 101 changes the waveshape (tone color) of the waveshape data signal $WV_0$ and outputs it as the waveshape data signal $WV_1$. The waveshape signal $WV_1$ provided by the tone color circuit 101 is applied to the multiplier 103 in which it is weighted by being multiplied with the coefficient $E_2$.

The weighted waveshape signals $E_1.WV_0$ and $E_2.WV_1$ are mixed by being added together in the adder 104 and the mixed signal is further weighted by being multiplied with the coefficient $E_3$.

Figure 3A:
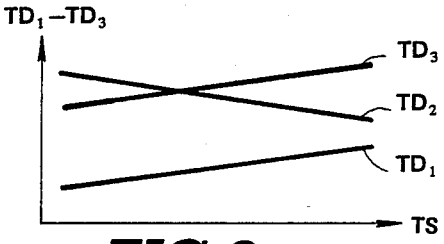
Figure 3C:
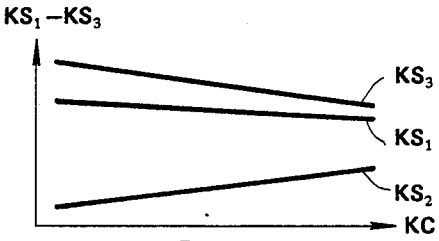

If, for example, the filter characteristics of the tone color circuit 101 is high-pass filter characteristics, the key scaling control circuit 14 produces key scaling information $KS_1$–$KS_3$ as shown in FIG. 3*c* and the relation between the coefficients $E_1$–$E_3$ produced by the coefficient generation circuits 106–108 and the key scaling information $KS_1$–$KS_3$ is established as shown in the graph of FIG. 4, as the frequency increases a greater weight is given to the waveshape signal $E_2WV_1$ than to the waveshape signal $E_1.WV_0$ between the two waveshape signals mixed in the adder 104 with a result that a tone of a higher frequency is more emphasized in its harmonic components of higher orders. Since the coefficient $E_3$ for the mixed tone becomes smaller as the frequency increases, the amplitude of the resultant tone becomes proportionally smaller as the frequency increases.

If, likewise, the relation between the touch data $TD_1$–$TD_3$ and the coefficients $E_1$–$E_3$ is established as shown in the graph of FIG. 5, the higher the depression speed or the greater the depression strength of the key, the greater becomes the weight given on the waveshape data $WV_1$ produced by the tone color circuit 101 than that given on the waveshape data $WV_0$ produced by the waveshape memory 100 so that a tone in which harmonic components of higher orders are more emphasized and amplitude becomes greater as the key touch increases is obtained.

If the relation between the envelope signals $ENV_1$, $ENV_2$ and the coefficients $E_1$, $E_2$ is established as shown in the graph of FIG. 6, a tone in which harmonic components of higher orders are emphasized in the rise portion of the tone and harmonic components of higher orders are restrained in the decay portion of the tone is obtained.

With respect to the control knob information $OPD_1$–$OPD_3$ produced by the control knob circuit 15, the tone color and volume of the tone can be varied similarly depending upon the operated states of the control knobs by suitably establishing the relation between the control knob information $OPD_1$–$OPD_3$.

A more complicated variation in the tone color can be achieved by applying, as shown by a dotted line in FIG. 1, the key code KC, touch information TS, control knob information $OPD_1$–$OPD_3$ to the envelope signal generation circuit 13 and suitably changing the rise time and decay time and levels of respective portions of the envelope signals $ENV_1$–$ENV_3$ in accordance with the tone range, depression speed or strength of the depressed key and the operated states of the control knobs in the control knob circuit 15.

In the above described embodiment, the waveshape data signal $WV_0$ produced by the waveshape memory 100 is considered as a main tone source and the waveshape data signal $WV_1$ produced by the tone color circuit 101 as a subordinate tone source. The same effect, however, can be obtained even if this relation is reversed. Further, in the above embodiment, the ratio of mixing of the two waveshape signals $WV_0$ and $WV_1$ and the amplitude level after mixed are controlled by the coefficients $E_1$–$E_3$ . By similarly controlling the filter characteristics of the tone color circuit 101, the tone color of the tone can be variably controlled in a more complicate manner.

FIG. 7 is a block diagram showing another example of the tone generator 10. The tone generator 10' of this example is of a monophonic construction (i.e., having only one tone generation channel) being exclusively used for a monophonic type of electronic musical instrument. In this tone generator 10', the tone color circuit 101 is constructed of a shift register 1010, a selector 1011 and a decoder 1012. The waveshape data signal $WV_0$ read out from the waveshape memory 100 is sequentially transferred by a unit of the sample point (one unit for one memory address) to respective stages of the shift register 1010 in response to the note clock signal NCK. Delayed waveshape data $WV_0$ of the each sample point is delivered out of the respective stages and applied to the selector 1011. The amplitude level of the waveshape signal $WV_0$ delivered out of the last stage nt time before (n being the number of stages and t being interval between sample points) is decoded by the decoder 1012 and, in accordance with the amplitude level of waveshape signal $WV_0$ of nt time before, outputs of the respective stages of the shift register 1010 are selected by the selector 1011 and the selected outputs are applied to the multiplier 103 as the waveshape information $WV_1$.

According to this construction, since the waveshape data $WV_1$ produced by the selector 1011 is based on sample points which are different from the sample points designated by the address signal AD and besides the sample points of the output waveshape data $WV_1$ vary irregularly, there is provided waveshape data $WV_1$ representing a waveshape which is equivalent to one obtained by a feedback frequency modulation system modulating the address signal AD in response to the output of the waveshape memory 100.

Instead of applying the last stage output of the shift register 1010 to the decoder 1012, the output of the selector 1011 may be applied to the decoder 1012. Instead of being controlled by the output of the decoder 1012, the selector 1011 may alternately be controlled by the output of a modulating waveshape memory 1013 which is read by a desired address signal AD' (it may be the same as the address signal AD) as shown in FIG. 7A. In either case, the selector 1011 produces waveshape information $WV_1$ representing a waveshape which is modulated in a complicated manner. Further, by providing a digital filter 1014 on the input side of the shift register 1010 as indicated in FIG. 7A and controlling the filter characteristic of this filter 1014 by the coefficient $E_3$, there is provided waveshape data signal $WV_1$ representing a waveshape which is equivalent to one which has been imparted with a frequency modulation effect in a predetermined frequency range.

According to this embodiment, in realizing various tone color changes, waveshape data having a first tone color read out from the waveshape memory and the waveshape data having a second tone color obtained by changing the first waveshape data are mixed at a proper ratio with the aid of tone color adjusting information from the key scaling control circuit and, accordingly, the circuit construction is greatly simplified because only one waveshape memory is required and the ratio of mixing has only to be controlled.

Referring to FIG. 8, another example of the tone generator 10 will be described. In a waveshape memory 20, waveshape data concerning the full waveshape from the start of sounding of a tone to the end thereof is stored in the pulse code modulation (PCM) format and a set of such waveshape data concerning the full waveshape is stored separately for each of tones which can be selected by the tone color selection circuit 9. The tone color selection information TC is applied to the waveshape memory 20 to designate a set of waveshape data to be read from the memory 20 in accordance with the selected tone color. In the waveshape memory 20, the set of waveshape data designated by the tone color selection information TC is sequentially read out sample point by sample point in response to the address signal AD applied from the address counter 5 (FIG. 1) to the address input of the waveshape memory and the waveshape signal $WV_0$ thereby is produced.

The waveshape signal $WV_0$ produced on the basis of the reading output of the waveshape memory 20 is applied to a non-linear circuit 21. The non-linear circuit 21 includes a non-linear conversion table which converts an input signal in accordance with a predetermined non-linear function and this non-linear conversion table (non-linear function) is provided for each tone color. One of the non-linear conversion tables (non-linear functions) is selected in response to the tone color selection information TC. The level at each sample point of the input waveshape signal $WV_0$ is converted in accordance with the non-linear function with a result that a waveshape-converted waveshape signal $WV_1$ is provided from the non-linear circuit 21.

Figures 9A, 9B, 9C:
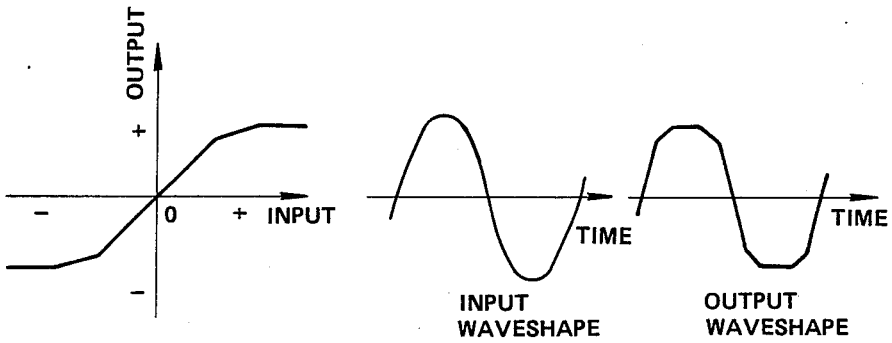

An example of the non-linear function is shown in FIG. 9*a*. In this example, if a waveshape signal of a sine wave as shown in FIG. 9*b* is applied, the waveshape-converted waveshape signal as shown in FIG. 9*c* is produced. Although the input waveshape signal in FIG. 9*b* does not contain harmonic components, the output waveshape signal in FIG. 9*c* contains harmonic components. As will be understood from this, the waveshape conversion according to the non-linear function achieves increase in harmonic components and broadening of the frequency bands of the harmonic components to higher frequency range.

The waveshape signal $WV_0$ provided by the waveshape memory 20 is applied to a multiplier 22 for weighting whereas the waveshape signal $WV_1$ provided by the non-linear circuit 21 is applied to a multiplier 23 for weighting. The respective multipliers 22 and 23 receive weighting coefficients $E_1$ and $E_2$ generated individually by coefficient generation circuits 24 and 25 and effect weighting (i.e., controling of amplitudes) of the applied signals $WV_0$ and $WV_1$ in accordance with the coefficients $E_1$ and $E_2$.

The coefficient generation circuits 24 and 25 generate weighting coefficients $E_1$ and $E_2$on the basis of various tone color change parameters. Among touch data $TD_1$–$TD_3$, envelope signals $ENV_1$–$ENV_3$, key scaling information $KS_1$–$KS_3$ and control knob $OPD_1$–$OPD_3$ produced by the circuits 12 through 15 in FIG. 1 as tone color change parameters, $TD_1$, $ENV_1$, $KS_1$ and $OPD_1$ are applied to the circuit 24 and $TD_2$, $ENV_2$, $KS_2$ and $OPD_2$ are applied at the circuit 25. A coefficient generation circuit 26 receives $TD_3$, $ENV_3$, $KS_3$ and $OPD_3$ among the above-mentioned data as amplitude control parameters and generates amplitude coefficient $E_3$ in response to these parameters. These coefficient generation circuits 24–26 consist of operation circuits such as addition circuits or coefficient memories or combinations thereof and generate the coefficients $E_1$–$E_3$ as functions of the applied parameters $TD_1$–$TD_3$, $ENV_1$–$ENV_3$, $KS_1$–$KS_3$, $OPD_1$–$OPD_3$. Further, as shown by a dotted line, tone color selection information TC may be applied to the circuits 24–26 so that contents of the coefficients $E_1$–$E_3$ will be changed in accordance with the tone color.

The waveshape signals $WV_0$ and $WV_1$ weighted by the multipliers 22 and 23 are added and by an adder 27 whereby a tone signal imparted with a desired tone color change according to the tone color change parameters is derived. The tone signal provided by the adder 27 is supplied to a multiplier 28 where it is controlled in its amplitude (volume) in response to the amplitude coefficient $E_3$ provided by the coefficient circuit 26. This output of the multiplier 28 is delivered out of the tone generator 10 as the tone signal G.

The circuits 20–28 constituting the tone generator 10 are all operated on a time shared basis thereby forming the tone signal G assigned to the respective tone generation channels on a time shared basis.

Degree of the tone color change is basically determined by the weighting coefficients $E_1$ and $E_2$. If, for example, a principal tone color in the tone signal G is characterized by the waveshape signal $WV_0$ from the waveshape memory 20, content of the waveshape signal $WV_1$ in the tone signal G is relatively enhanced and the tone color change relative to the principal tone color increases if the weighting coefficients $E_1$ and $E_2$ are so set that $E_1$ will be always larger than $E_2$ and the weighting coefficients are controlled under this condition so that the difference between $E_1$ and $E_2$ decreases. If the weighting coefficients are controlled so that the difference between $E_1$ and $E_2$ increases, content of the waveshape signal $WV_1$ in the tone signal G is relatively weakened and the tone color change relative to the principal tone color decreases. If, conversely, the principal tone color in the tone signal G is characterized by the waveshape signal $WV_1$ from the non-linear circuit 21, the weighting coefficients $E_1$ and $E_2$ are so set that $E_2$ is always larger than $E_1$ and the tone color change is controlled under this condition depending upon the difference between $E_1$ and $E_2$.

If, for example, the key scaling information $KS_1$–$KS_3$ are generated with characteristics as shown in FIG. 3*c* and the coefficients $E_1$–$E_3$ are generated in correspondence thereto, the weighting control by the weighting coefficients $E_1$ and $E_2$ corresponding to the key scaling information $KS_1$ and $KS_2$ is so performed that the higher the frequency of the tone to be generated, ratio of the waveshape $WV_0$ decreases and the ratio of the waveshape $WV_1$ increases resulting in a greater tone color change. In the volume control by the coefficient $E_3$ corresponding to $KS_3$, a key scaling corresponding to hearing in which volume decreases as the frequency of the tone increase is realized.

If the touch data $TD_1$–$TD_3$ are generated with characteristics as shown in FIG. 3*a* and the coefficients $E_1$–$E_3$ are generated with characteristics corresponding thereto, the weighting control by the weighting coefficients $E_1$ and $E_2$ corresponding to $TD_1$ and $TD_2$ is so performed that the ratio of the waveshape signal $WV_0$ decreases and the ratio of the waveshape signal $WV_1$ increases as the key touch increases with resulting increase in the tone color change. In the volume control by the coefficient $E_3$ corresponding to $TD_3$, the volume increases as the key touch increases.

Figure 3B:
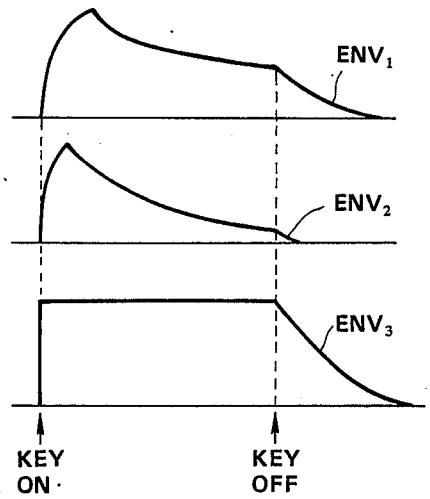

Further, if the envelope signals $ENV_1$–$ENV_3$ are generated with characteristics shown in FIG. 3*b* and the coefficients $E_1$–$E_3$ are generated with characteristics corresponding thereto, the coefficients $E_1$ and $E_2$ have attack and decay characteristics which change timewise as shown in FIG. 3*b*. Accordingly, the weighting ratio is controlled in correspondence to the rise and fall of a tone and tone color change corresponding thereto is realized. In the envelope signal generation circuit 13, the envelope signals $ENV_1$–$ENV_3$ can be provided with shapes peculiar thereto by independently controlling the attack time, attack level, sustain level, decay level and decay time of the envelope signals. The envelope signal $ENV_3$ corresponding to the amplitude coefficient $E_3$ maintains a constant level during depression of a key as shown in FIG. 3*b* for the waveshape signal $WV_0$ from the waveshape memory 20 has at least been provided with a volume envelope of the attack portion.

In the example shown in FIG. 8 also, corresponding coefficients $E_1$–$E_3$ are generated for the operator information $OPD_1$–$OPD_3$ in the same manner as was previously described and corresponding tone color change control and volume control are performed.

In the above described example, only one channel of the non-linear circuit 21 is provided. Alternatively, the non-linear circuit 21 may be provided in plural channels as shown in FIG. 10. Non-linear circuits 21*a*–21*n* of the respective channels perform waveshape conversion operations according to different non-linear functions. Outputs of these circuits 21*a*–21*n* are applied to multipliers 23*a*–23*n* for weighting where they are weighted by weighting coefficients $E_{2a}$–$E_{2n}$. The weighted signals are added and synthesized by an adder 29 and a synthesized signal is applied to an adder 27 (FIG. 8) for being added with a waveshape signal $WV_0$.

As shown in FIG. 11, the outputs of the non-linear circuits 21*a*–21*n* may be selected by a selector 30 and the selected output may be given to the adder 27. A selection signal $E_4$ should preferably be generated in response to tone color change parameters such as key scaling, key touch and operator output in the same manner as in the above-described coefficients $E_1$–$E_3$.

A tone signal may be generated on the basis of the output $WV_1$ of the non-linear circuit 21 without synthesizing of the output $WV_0$ of the waveshape memory 20 and the non-linear circuit 21. In this case, the circuits 22, 25 and 27 in FIG. 8 are omitted and the output $WV_1$ of the non-linear circuit 21 is applied directly to the multiplier 28. In this case also, the non-linear circuits 21*a*–21*n* of plural channels as shown in FIGS. 10 and 11 may be employed in which case the tone color change control can be advantageously effected.

In the above described embodiments, description has been made on the assumption that the waveshape memory stores a full waveshape from rise (start of sounding) to fall (end of sounding) of a tone. Alternatively, the waveshape memory may store a full waveshape of the rise portion and a part of subsequent waveshape of a tone. Instead of storing waveshape data of all sample points in a waveshape to be generated, the waveshape memory may store waveshape data of skipped sample points only and waveshape data of intermediate sample points may be calculated by an interpolation operation. Waveshape of plural periods to be stored in the waveshape memory need not necessarily be continuous plural periods but may be skipped periods. For example, an arrangement may be made such that a tone waveshape from its rising to decaying are divided into several frames and representative waveshape data of waveshapes of one or two periods for each of these frames are stored and such waveshape data is repeatedly read waveshape data after another. Thus, the waveshape memory stores waveshape data of a tone waveshape defining a first tone color which varies with time and which includes plural vibratory cycles which are at least portional extracts from a whole vibratory wave from its start of sounding to the end thereof. Further, if necessary, in switching of waveshape data, a smoothly changing waveshape may be formed by interpolating interval between a preceding waveshape and a subsequent waveshape. Further, as disclosed in Japanese Preliminary Patent Publication No. 142396/1983, waveshape data of a tone waveshape for plural periods only may be stored and this waveshape data may be repeatedly read out. By such arrangement, the capacity of a waveshape memory can be further reduced.

The method for coding waveshape data to be stored in the waveshape memory is not limited to the above-described PCM system but other suitable methods such as the difference PCM method, delta modulation (DM) system, adapted PCM (ADPCM) system and adapted delta modulation (ADM) system may be used. In that case, a demodulation circuit for demodulating the output read out from the waveshape memory (i.e., obtaining a pulse-code-modulated signal) according to the employed coding method is provided on the output side of the waveshape memory.

In the above embodiments, the coefficient generation circuit is of such a construction as to respond to all of the key scaling information, envelope signals, touch data operator information and tone color selection information. Alternatively, the coefficient generation circuit may respond only to a part of such information. The characteristic curves shown in FIG. 3 are only exemplary and any other suitable curves may be formed depending upon the tone color and other factors.

In the above embodiments, the address signal for reading out waveshape data in the waveshape memory is formed by counting the note clock signal. The address signal may instead be formed by accumulating or adding or subtracting frequency information corresponding to the tone pitch of a depressed key. Depending upon the construction of the waveshape memory, the address signal may remain to be the note clock signal instead of being converted into a binary code. In the case where the waveshape memory stores waveshape data with respect to each tone pitch, the address signal may be generated at a changing rate which is common to all tone pitches.

In the above embodiments, a tone is generated applying the present invention to its entire period from the rise to the fall thereof. A tone may be generated applying the invention to only a part of period (e.g., the attack portion or a connecting portion after the attack portion).

In the above embodiments, the waveshape signal $WV_0$ and waveshape signal $WV_1$ are electrically mixed in the adder. Alternatively, tones corresponding to the waveshape signals $WV_0$ and $WV_1$ may be sounded from separate loud-speakers and mixed acoustically (spatially).

The present invention is applicable not only to polyphonic electronic musical instruments but also to monophonic electronic musical instruments. The invention is also applicable not only to generation of tones corresponding to scale notes but also to generation of rhythm sounds.

Further, instead of weighting both the output of the waveshape memory and the output of the tone color circuit (or non-linear circuit) as in the above described embodiments, one of these outputs only may be weighted and the other may be left unweighted.

According to the present invention, a tone signal is generated by combining waveshape data read out from the waveshape memory and waveshape data derived by converting this waveshape data at a ratio corresponding to tone color adjusting information obtained by key scaling control or other controls and, accordingly, notwithstanding the fact that only a single high-quality waveshape is stored in the waveshape memory, similar high-quality waveshapes can be realized with various tone colors (i.e., tone color change depending upon the key touch or tone pitch of the depressed key or other tone' color changing factors) on the basis of the single stored waveshape. Consequently, such tone color change of high-quality can be achieved with a relatively small and inexpensive construction.

Moreover, according to the present invention, a high-quality waveshape signal is read out from a waveshape memory storing a waveshape consisting of plural periods and tone color change control is effected by waveshape-converting the read-out waveshape in accordance with a non-linear function and, accordingly, a high-quality tone color change can be achieved with a relatively small and inexpensive construction for the same reason as described above. Since a waveshape signal converted in accordance with the non-linear function can be caused to contain higher frequency components than an original waveshape signal (i.e., waveshape signal stored in the memory), the number of sampling may be reduced by decreasing the sampling frequency of the waveshape to be stored in the memory and the memory capacity thereby can be reduced while a tone signal finally obtained is of a high-quality one containing high frequency components.

I claim:

1. A tone signal generation device comprising:

tone pitch designation means for designating a tone pitch of a tone to be generated;

waveshape memory means for storing waveshape data representing a waveshape having plural harmonics defining a first tone color, which waveshape data is read out at a speed determined in accordance with the tone pitch designated by said tone pitch designation means;

waveshape changing means for changing the waveshape data read out from said waveshape memory means to form secondary waveshape data of a second tone color which is different from said first tone color;

tone color adjusting means for providing tone color adjusting signals;

combining means for combining the waveshape data read out from said waveshape memory means and the secondary waveshape data formed by said waveshape changing means according to a supplied mixing ratio to provide combined data as a tone signal; and combining ratio control means for controlling, responsive to the tone color adjusting signals, the mixing ratio of combining the two waveshape data in said combining means.

2. A tone signal generation device as defined in claim 1 wherein said tone color adjusting means includes a key scaling control circuit producing tone color adjusting signals of different values depending upon the tone pitch of tones to be generated.

3. A tone signal generation device as defined in claim 1 wherein said tone pitch designation means includes a keyboard including keys and said tone color adjusting means is a touch data generation circuit producing tone color adjusting signals of different values which is responsive to operator touch during operation of said keyboard, where said operation touch is defined to include at least either a speed or strength of actuation of said keyboard keys.

4. A tone signal generation device as defined in claim 1 wherein said tone color adjusting means includes a control knob circuit producing tone color adjusting signals of different values depending upon operation states of tone color control knobs.

5. A tone signal generation device as defined in claim 1 wherein said tone color adjusting means includes a tone color selection circuit producing tone color adjusting signals of different values depending upon contents of a tone color control knob information signal selected by a plurality of tone color control knobs.

6. A tone signal generation device as defined in claim 1 wherein said tone color adjusting means includes an envelope signal generation circuit producing, as part of the tone color adjusting signal, an envelope signal which changes timewisely in a period of time from the rise of a tone to the fall thereof.

7. A tone signal generation device as defined in claim 1 wherein said waveshape changing means includes a digital filter receiving the waveshape data read out from said waveshape memory means.

8. A tone signal generation device as defined in claim 1 wherein said combining ratio control means is a coefficient generation circuit generating coefficients determining the ratio of combining the two waveshape data in said combining means in response to contents of said tone color adjusting signal.

9. A tone signal generation device as defined in claim 1 wherein said waveshape changing means comprises a memory circuit sequentially storing waveshape data read out from said waveshape memory means, a modulating signal generation means for generating a modulating signal having an audio frequency, and readout control means for selecting waveshape data to be read out from said memory circuit in response to said modulating signal.

10. A tone signal generation device as defined in claim 9 wherein said modulating signal generation means generates a modulating signal in response to the waveshape information stored in said memory circuit.

11. A device as in claim 1 wherein the waveshape memory means stores plural periods of a tone to be generated from the beginning of generation to the end thereof.

12. A device as in claim 11 wherein the waveshape memory means stores plural consecutive periods of an initial portion of the tone to be generated and less than all of the periods of the remaining portion of the tone to be generated.

13. A device as in claim 11 wherein the waveshape memory means stores plural non-consecutive periods of the tone to be generated.

14. A tone signal generation device comprising:

a waveshape memory storing waveshape data having plural harmonics defining a first tone color;

waveshape changing means for changing a waveshape signal derived from a read out output of this waveshape memory to form a waveshape signal of a different tone color;

weighting means for individually weighting the waveshape signal derived from the read out output of said waveshape memory and the waveshape signal derived from the output of said waveshape changing means by different individual weighting coefficients and outputting the weighted waveshape signals;

weight coefficient generation means for generating the individual weighting coefficients; and combining means for combining said weighted waveshape signals and producing a tone signal whose tone color is determined by the output of said weighting means.

15. A tone signal generation means as defined in claim 14 wherein said waveshape changing means includes a non-linear conversion circuit for converting the waveshape signal derived from the read out output of said waveshape memory in accordance with a predetermined non-linear function.

16. A tone signal generation device as defined in claim 15 wherein said weighting coefficient generation means generates the weighting coefficients utilizing the tone pitch or tone range of the tone to be generated as a parameter.

17. A tone signal generation device as defined in claim 15 wherein said weighting coefficient generation means generates the weighting coefficients utilizing touch on a key for designating sounding of a tone as a parameter, where said touch is defined to include at least either a speed or strength of actuation applied to said key.

18. A tone signal generation device as defined in claim 15 wherein said weighting coefficient generation means generates the weighting coefficients utilizing an operation state of a predetermined operator control knob as a parameter.

19. A tone signal generation device as defined in claim 15 comprising plural channels each including a different non-linear conversion circuit for outputting waveshape signals of differing tone color; and means for weighting the waveshape signals derived from outputs of the respective channels by separate weighting coefficients provided in said weighting means.

20. A device as in claim 14 wherein the waveshape memory stores plural periods of a tone to be generated from the beginning of the generation of the tone to the end thereof.

21. A device as in claim 20 wherein the waveshape memory stores plural consecutive periods of an initial portion of the tone to be generated and less than all of the periods of the remaining portion of the tone to be generated.

22. A device as in claim 20 wherein the waveshape memory stores plural non-consecutive periods of the tone to be generated.

23. A tone signal generation device comprising:

a waveshape memory storing waveshape data of a tone waveshape defining a first tone color which varies with time and including plural vibratory cycles which are at least portional extracts from a whole vibratory wave of a tone from its start of sounding to the end thereof; and a non-linear conversion circuit, having an input and output, for converting a waveshape signal applied to said input and derived from a read-out output of said waveshape memory in accordance with a predetermined non-linear function to produce a second waveshape of a second tone color at the output of said conversion circuit said non-linear function including at least a first conversion characteristic for portions of the waveshape signal applied to said input having a first amplitude value and a second conversion characteristic different from the first conversion characteristic for portions of the waveshape signal applied to said input having a second amplitude value.

24. A tone signal generation device as defined in claim 23 wherein said non-linear conversion circuit includes a table storing plural non-linear functions which are different from one another whereby a non-linear function to be used for converting the waveshape signal can be selectively changed.

25. A device as in claim 23 wherein the waveshape memory stores plural consecutive vibratory cycles of an initial portion of the tone to be generated and less than all of the periods of the remaining portion of the tone to be generated.

26. A device as in claim 23 wherein the waveshape memory stores plural non-consecutive vibratory cycles of the tone to be generated.

* * * * *

UNITED STATES PATENT AND TRADEMARK OFFICE

CERTIFICATE OF CORRECTION

PATENT NO. : 4,939,973

DATED : July 10, 1990

INVENTOR(S) : Hideo Suzuki

It is certified that error appears in the above-identified patent and that said Letters Patent is hereby corrected as shown below:

On the title page, after "Assignee:", delete "Nippon Gakki Seizo Kabushiki" and substitute therefor --Yamaha Corporation--.

Signed and Sealed this

Seventh Day of April, 1992

*Attest:*

HARRY F. MANBECK, JR.

*Attesting Officer*

*Commissioner of Patents and Trademarks*